US011933018B2

(12) United States Patent
Ishihara et al.

(10) Patent No.: US 11,933,018 B2
(45) Date of Patent: Mar. 19, 2024

(54) BLADE CONTROL DEVICE AND BLADE CONTROL METHOD

(71) Applicant: Komatsu Ltd., Tokyo (JP)

(72) Inventors: Takao Ishihara, Tokyo (JP); Daichi Noborio, Tokyo (JP); Yutaka Nakayama, Tokyo (JP)

(73) Assignee: Komatsu Ltd., Tokyo (JP)

( * ) Notice: Subject to any disclaimer, the term of this patent is extended or adjusted under 35 U.S.C. 154(b) by 658 days.

(21) Appl. No.: 17/047,881

(22) PCT Filed: Jan. 28, 2019

(86) PCT No.: PCT/JP2019/002788

§ 371 (c)(1),
(2) Date: Oct. 15, 2020

(87) PCT Pub. No.: WO2019/230043

PCT Pub. Date: Dec. 5, 2019

(65) Prior Publication Data

US 2021/0156110 A1 May 27, 2021

(30) Foreign Application Priority Data

May 29, 2018 (JP) ..... 2018-102632

(51) Int. Cl.
*E02F 3/84* (2006.01)
*E02F 9/26* (2006.01)

(52) U.S. Cl.
CPC ..... *E02F 3/844* (2013.01); *E02F 9/262* (2013.01)

(58) Field of Classification Search
CPC . E02F 3/844; E02F 9/261; E02F 9/262; E02F 9/2045
See application file for complete search history.

(56) References Cited

U.S. PATENT DOCUMENTS 8,948,981 B2 * 2/2015 Wei et al. ..... E02F 9/2045 701/50
9,014,924 B2 4/2015 Edara et al.
9,506,224 B2 * 11/2016 Kontz ..... G05B 13/04
9,507,348 B2 11/2016 Payne et al.
10,208,453 B2 * 2/2019 Taylor et al. ..... E02F 3/841
(Continued)

FOREIGN PATENT DOCUMENTS

CN 101117809 A 2/2008
CN 107532403 A 1/2018
(Continued)

OTHER PUBLICATIONS

International Search Report dated Apr. 9, 2019, issued for PCT/JP2019/002788.

*Primary Examiner* — Thomas B Will
*Assistant Examiner* — Joel F. Mitchell
(74) *Attorney, Agent, or Firm* — Locke Lord LLP

(57) ABSTRACT

A blade control device includes: a corrected design surface generation unit that generates a corrected design surface connecting a first surface existing in front of a work vehicle and a second surface having a different slope from a slope of the first surface on an initial design surface indicating a target shape of an excavation object to be excavated using a blade of the work vehicle; and a blade control unit that outputs a control command to control a height of the blade based on the corrected design surface.

7 Claims, 7 Drawing Sheets

(56) References Cited

U.S. PATENT DOCUMENTS

| | | | | |
|---|---|---|---|---|
| 2014/0012404 | A1* | 1/2014 | Taylor et al. | G06F 30/13 700/97 |
| 2016/0122969 | A1 | 5/2016 | Noborio et al. | |
| 2016/0201298 | A1 | 7/2016 | Taylor et al. | |
| 2016/0231752 | A1 | 8/2016 | Payne et al. | |
| 2018/0038082 | A1 | 2/2018 | Hashimoto et al. | |
| 2019/0078296 | A1 | 3/2019 | Ishibashi et al. | |
| 2019/0194912 | A1 | 6/2019 | Ishibashi et al. | |

FOREIGN PATENT DOCUMENTS

| | | | |
|---|---|---|---|
| FR | 2071968 | A1 | 9/1971 |
| JP | S63-103135 | A | 5/1988 |
| JP | 2018-016970 | A | 2/2018 |
| JP | 2018-021348 | A | 2/2018 |
| JP | 2018-021427 | A | 2/2018 |
| JP | 2018-071256 | A | 5/2018 |
| NZ | 554197 | A | 7/2009 |
| WO | 2008/118027 | A2 | 10/2008 |
| WO | 2015/083469 | A1 | 6/2015 |

* cited by examiner

BLADE CONTROL DEVICE AND BLADE CONTROL METHOD

FIELD

The present invention relates to a blade control device and a blade control method.

BACKGROUND

A work vehicle having a blade is used for excavating or leveling an excavation object. There has been a proposed work vehicle that controls the blade to follow a design surface. The design surface refers to a target shape of the excavation object.

CITATION LIST

Patent Literature

Patent Literature 1: WO 2015/083469 A

SUMMARY

Technical Problem

The blade is driven by a hydraulic system. The hydraulic system is driven based on a control command output from a blade control device. There may be a plurality of surfaces with different slopes on a design surface. An occurrence of control delay at the time of passage of the blade through a boundary between surfaces of different slopes might cause the blade to fail to follow the design surface. As a result, the blade might excavate the excavation object beyond the design surface, leading to a failure in excavating the excavation object into a desired shape.

An aspect of the present invention is to excavate an excavation object into a desired shape.

Solution to Problem

According to an aspect of the present invention, a blade control device comprises: a corrected design surface generation unit that generates a corrected design surface connecting a first surface existing in front of a work vehicle and a second surface having a different slope from a slope of the first surface on an initial design surface indicating a target shape of an excavation object to be excavated using a blade of the work vehicle; and a blade control unit that outputs a control command to control a height of the blade based on the corrected design surface.

Advantageous Effects of Invention

According to an aspect of the present invention, it is possible to excavate an excavation object into a desired shape.

DESCRIPTION OF EMBODIMENTS

Figure 1:
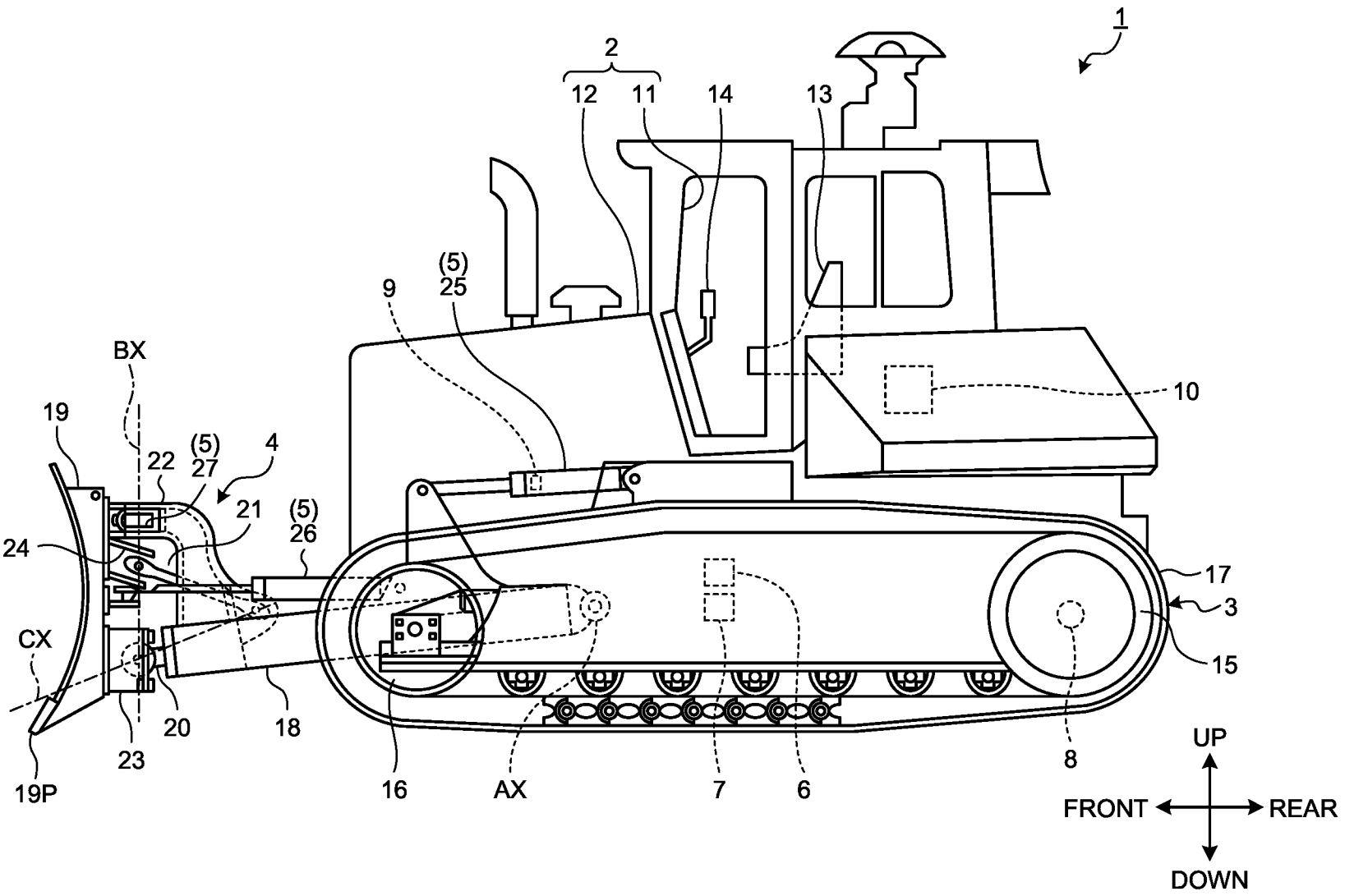
FIG. 1 is a view illustrating a work vehicle according to the present embodiment.

Hereinafter, embodiments according to the present invention will be described with reference to the drawings, although the present invention is not limited to the embodiments. It is possible to appropriately combine the constituents described in the embodiments below. In some cases, a portion of the constituents is not utilized.

In the following, a global coordinate system and a local coordinate system are defined, and the positional relationship of individual components will be described. The global coordinate system is a coordinate system determined with respect to an origin fixed to the earth. The global coordinate system is a coordinate system defined by a Global Navigation Satellite System (GNSS). GNSS is a global navigation satellite system. An exemplary global navigation satellite system includes a global positioning system (GPS). GNSS includes a plurality of positioning satellites. GNSS detects a position defined by coordinate data of latitude, longitude, and altitude. The local coordinate system is a coordinate system determined with respect to an origin fixed to a vehicle body 2 of a work vehicle 1. In the local coordinate system, the up-down direction, the left-right direction, and the front-back direction are defined. As will be described below, the work vehicle 1 includes: the vehicle body 2 provided with a seat 13 and an operation device 14; and a carriage device 3 including driving wheels 15 and crawler 17. The up-down direction refers to a direction orthogonal to the ground contact surface of the crawler 17. The left-right direction is a direction parallel to the rotational axis of the driving wheels 15. The left-right direction is synonymous with a vehicle width direction of the work vehicle 1. The front-back direction is a direction orthogonal to the left-right direction and the up-down direction.

The upper side corresponds to one direction in the up-down direction and is a direction away from the ground contact surface of the crawler 17. The lower side corresponds to a direction opposite to the upper side in the up-down direction and is a direction approaching the ground contact surface of the crawler 17. The left side corresponds to one direction in the left-right direction and is a left-side direction with respect to the driver of the work vehicle 1 seated on the seat 13 so as to face the operation device 14. The right side corresponds to the opposite direction to the left side in the left-right direction and is the right-side direction with respect to the driver of the work vehicle 1 seated on the seat 13. The front side correspond to one direction in the front-rear direction and is a direction from the seat 13 toward the operation device 14. The rear side corresponds to a direction opposite to the front side in the front-rear direction and is a direction from the operation device 14 toward the seat 13.

Furthermore, the upper portion corresponds to an upper-side portion of the member or space in the up-down direction and is a portion separated from the ground contact surface of the crawler 17. The lower portion corresponds to a lower-side portion of the member or space in the up-down direction and is a portion of the crawler 17 close to the ground contact surface. The left portion corresponds to a left-side portion of a member or space with respect to a driver of the work vehicle 1 seated on the seat 13. The right portion corresponds a right-side portion of the member or space with respect to the driver of the work vehicle 1 seated on the seat 13. The front portion corresponds to a front-side portion of the member or space in the front-rear direction. The rear portion corresponds to a rear-side portion of the member or space in the front-rear direction.

[Work Vehicle]

Figure 2:
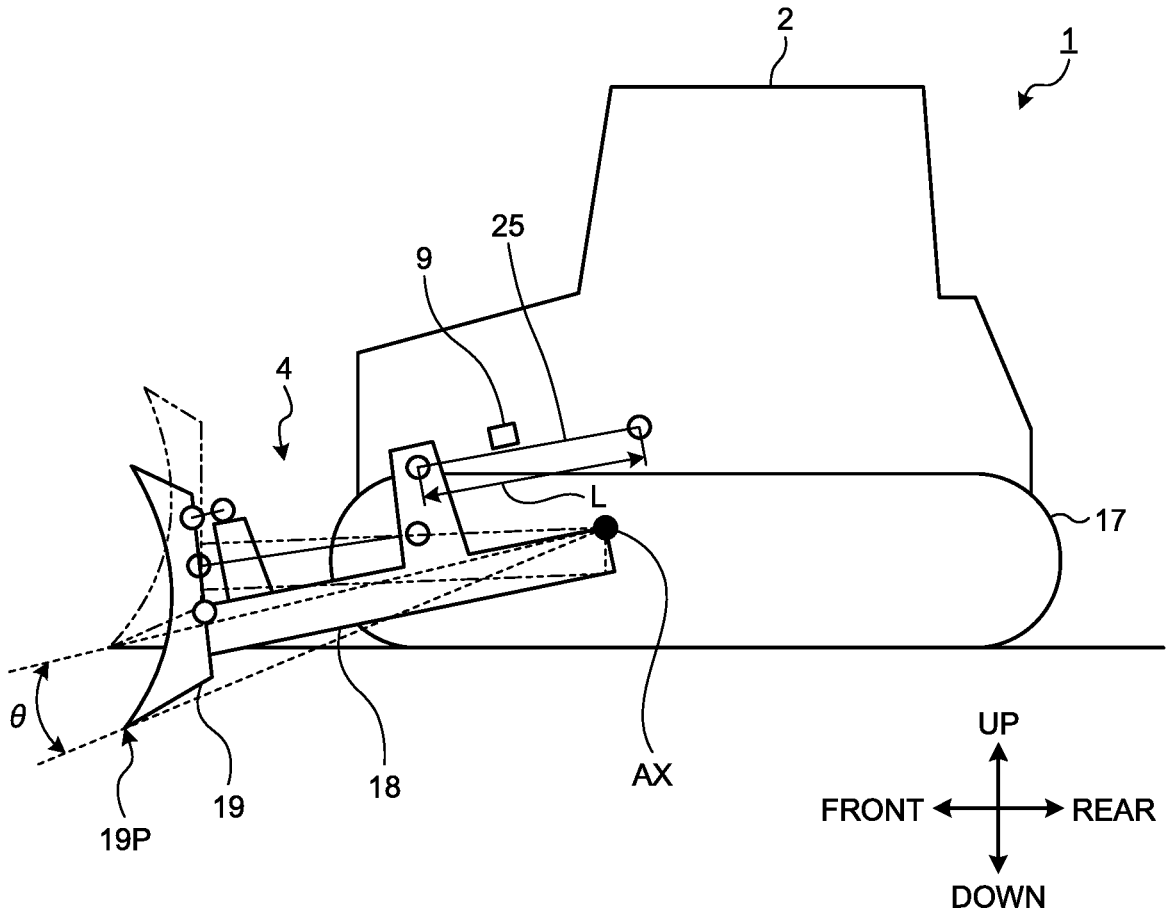
FIG. 2 is a view schematically illustrating the work vehicle according to the present embodiment.

FIG. 1 is a view illustrating the work vehicle 1 according to the present embodiment. FIG. 2 is a schematic view illustrating the work vehicle 1 according to the present embodiment. In the present embodiment, the work vehicle 1 is a bulldozer. The work vehicle 1 includes a vehicle body 2, a carriage device 3, working equipment 4, a hydraulic cylinder 5, a position sensor 6, an inclination sensor 7, a speed sensor 8, an operation amount sensor 9, and a blade control device 10.

The vehicle body 2 has a cab 11 and an engine room 12. The engine room 12 is arranged in front of the cab 11. The cab 11 includes: a seat 13 on which a driver sits; and an operation device 14 operated by the driver. The operation device 14 includes: a working lever for operating the working equipment 4; and a traveling lever for operating the carriage device 3.

The carriage device 3 supports the vehicle body 2. The carriage device 3 includes: a driving wheel 15 called a sprocket; an idle wheel 16 called an idler; and a crawler 17 supported by the driving wheel 15 and the idle wheel 16. The idle wheel 16 is arranged in front of the driving wheel 15. The driving wheel 15 is driven by power generated by a drive source such as a hydraulic motor. The driving wheel 15 is rotated by operating the traveling lever of the operation device 14. Rotation of the driving wheels 15 rotates the crawler 17 to allow the work vehicle 1 to travel.

The working equipment 4 is movably supported by the vehicle body 2. The working equipment 4 has a lift frame 18 and a blade 19.

The lift frame 18 is supported by the vehicle body 2 so as to be pivotable in the up-down direction about a rotational axis AX extending in the vehicle width direction. The lift frame 18 supports the blade 19 via a ball joint 20, a pitch support link 21, and a support pillar 22.

The blade 19 is arranged in front of the vehicle body 2. The blade 19 includes: a universal joint 23 that comes in contact with the ball joint 20; and a pitching joint 24 that comes in contact with the pitch support link 21. The blade 19 is movably supported by the vehicle body 2 via the lift frame 18. The blade 19 moves in the up-down direction in conjunction with the up-down pivot of the lift frame 18.

The blade 19 has a cutting edge 19P. The cutting edge 19P is arranged at a lower end of the blade 19. In excavation work or leveling work, the cutting edge 19P excavates an excavation object.

The hydraulic cylinder 5 generates power to move the working equipment 4. The hydraulic cylinder 5 includes a lift cylinder 25, an angle cylinder 26, and a tilt cylinder 27.

The lift cylinder 25 is a hydraulic cylinder 5 that can move the blade 19 in the up-down direction (lift direction). The lift cylinder 25 is coupled to the vehicle body 2 and the lift frame 18 on either side. The expansion and contraction of the lift cylinder 25 causes the lift frame 18 and the blade 19 to move in the up-down direction about the rotational axis AX.

The angle cylinder 26 is the hydraulic cylinder 5 that allows pivot movement of the blade 19 in the rotational direction (angular direction). The angle cylinder 26 is coupled to the lift frame 18 and the blade 19 on either side. The expansion and contraction of the angle cylinder 26 causes the blade 19 to pivot about a rotational axis BX. The rotational axis BX passes through a rotational axis of the universal joint 23 and a rotational axis of the pitching joint 24.

The tilt cylinder 27 is a hydraulic cylinder 5 that allows pivot movement of the blade 19 in the rotational direction (tilt direction). The tilt cylinder 27 is coupled to the support pillar 22 of the lift frame 18 and to an upper right end of the blade 19. The expansion and contraction of the tilt cylinder 27 causes the blade 19 to pivot about a rotational axis CX. The rotational axis CX passes through the ball joint 20 and the lower end of the pitch support link 21.

The position sensor 6 detects the position of the vehicle body 2 of the work vehicle 1. The position sensor 6 includes a GPS receiver and detects the position of the vehicle body 2 in the global coordinate system. The detection data of the position sensor 6 includes vehicle body position data indicating the absolute position of the vehicle body 2.

The inclination sensor 7 detects an inclination angle of the vehicle body 2 with respect to a horizontal plane. The detection data of the inclination sensor 7 includes vehicle body angle data indicating the inclination angle of the vehicle body 2. The inclination sensor 7 includes an inertial measurement unit (IMU).

The speed sensor 8 detects a traveling speed of the carriage device 3. The detection data of the speed sensor 8 includes traveling speed data indicating the traveling speed of the carriage device 3.

The operation amount sensor 9 detects an operation amount of the hydraulic cylinder 5. The operation amount of the hydraulic cylinder 5 includes a stroke length of the hydraulic cylinder 5. The detection data of the operation amount sensor 9 includes operation amount data indicating the operation amount of the hydraulic cylinder 5. The operation amount sensor 9 includes: a rotating roller that detects the position of a rod of the hydraulic cylinder 5; and a magnetic force sensor that returns the rod position to the origin. The operation amount sensor 9 may be an angle sensor that detects the inclination angle of the working equipment 4. Furthermore, the operation amount sensor 9 may be an angle sensor that detects a rotation angle of the hydraulic cylinder 5.

The operation amount sensor 9 is provided in the lift cylinder 25, the angle cylinder 26, and the tilt cylinder 27 individually. The operation amount sensor 9 detects the stroke length of the lift cylinder 25, the stroke length of the angle cylinder 26, and the stroke length of the tilt cylinder 27.

As illustrated in FIG. 2, a lift angle A of the blade 19 is calculated based on a stroke length L of the lift cylinder 25. The lift angle A represents a descending angle of the blade 19 from the origin position of the working equipment 4. As illustrated by the long-dashed double short-dashed line in FIG. 2, the origin position of the working equipment 4 refers to the position of the working equipment 4 when the cutting edge 19P of the blade 19 comes in contact with a predetermined surface parallel to the ground contact surface of the crawler 17. The lift angle A corresponds to a distance (penetration depth) between the predetermined surface and the cutting edge 19P disposed below the predetermined surface. Excavation work or ground leveling work using the blade 19 is performed with the forward movement of the work vehicle 1 in a state where the cutting edge 19P of the blade 19 is positioned below a predetermined surface.

[Blade Control Device]

Figure 3:
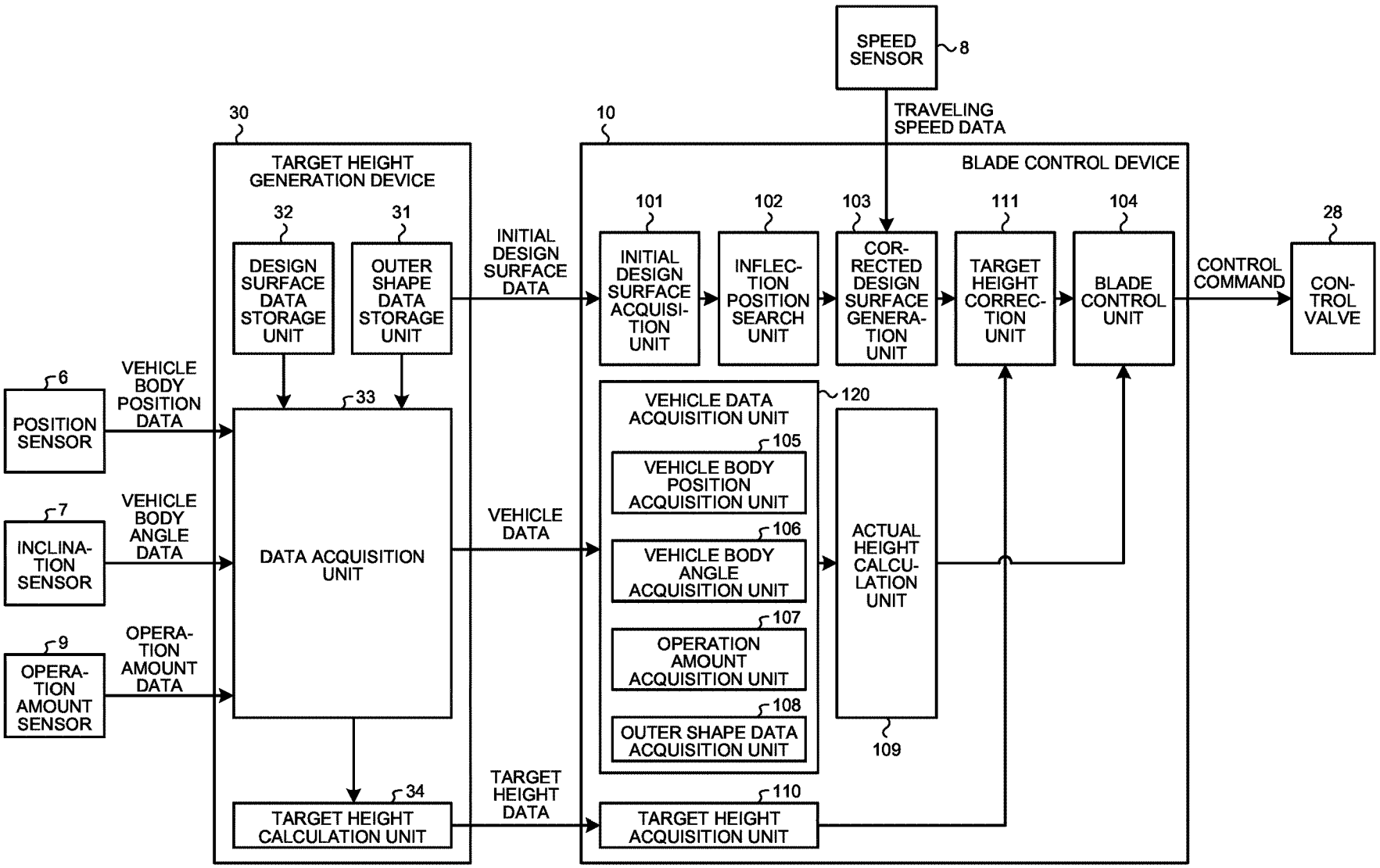
FIG. 3 is a functional block diagram illustrating a blade control device according to the present embodiment.

FIG. 3 is a functional block diagram illustrating a blade control device 10 according to the present embodiment. The blade control device 10 includes a computer system. The blade control device 10 is connected to a target height generation device 30. The target height generation device 30 includes a computer system.

The blade control device 10 outputs a control command to control the height of the cutting edge 19P of the blade 19. The control command includes a drive command to drive the lift cylinder 25 capable of moving the blade 19 in the up-down direction.

The blade control device 10 outputs the control command to a control valve 28 that controls the flow rate and direction of the hydraulic oil supplied to the lift cylinder 25 and thereby controls the height of the cutting edge 19P. The control command output from the blade control device 10 includes a current to control the control valve 28.

The control valve 28 includes a proportional control valve. The control valve 28 is disposed in an oil passage between a hydraulic pump (not illustrated) that discharges hydraulic oil for driving the blade 19, and the lift cylinder 25. The hydraulic pump supplies hydraulic oil to the lift cylinder 25 via the control valve 28. The lift cylinder 25 is driven based on the hydraulic oil controlled by the control valve 28.

The target height generation device 30 generates target height data indicating the target height of the cutting edge 19P of the blade 19 based on an initial design surface IS indicating the target shape of the excavation object. The target height of the cutting edge 19P refers to a position of the cutting edge 19P that can be aligned with the initial design surface IS in the local coordinate system.

<Target Height Generation Device>

The target height generation device 30 includes a design surface data storage unit 31, an outer shape data storage unit 32, a data acquisition unit 33, and a target height calculation unit 34.

The design surface data storage unit 31 stores initial design surface data indicating the initial design surface IS which is the target shape of the excavation object. The initial design surface IS includes three-dimensional shape data indicating the target shape of the excavation object. The initial design surface IS includes Computer Aided Design (CAD) data created based on the target shape of the excavation object, for example, and is stored in the design surface data storage unit 31 in advance.

The design surface data may be transmitted from the outside of the work vehicle 1 to the target height generation device 30 via a communication line.

The outer shape data storage unit 32 stores outer shape data indicating the size and shape of the work vehicle 1. The dimensions of the work vehicle 1 include the dimensions of the lift frame 18 and the blade 19. The shape of the work vehicle 1 includes the shape of the blade 19. The outer shape data is known data that can be derived from design data or specification data of the work vehicle 1 and that is stored in advance in the outer shape data storage unit 32.

The data acquisition unit 33 acquires vehicle data indicating data related to the work vehicle 1. At least a part of the vehicle data is detected by a vehicle data sensor provided in the work vehicle 1. The data acquisition unit 33 acquires vehicle data from the vehicle data sensor. The vehicle data sensor includes the position sensor 6, the inclination sensor 7, and the operation amount sensor 9. The vehicle data includes: vehicle body position data indicating the absolute position of the vehicle body 2; vehicle body angle data indicating the inclination angle of the vehicle body 2; operation amount data indicating the stroke length of the lift cylinder 25; and outer shape data of the work vehicle 1. The data acquisition unit 33 acquires the vehicle body position data from the position sensor 6. The data acquisition unit 33 acquires the vehicle body angle data from the inclination sensor 7. The data acquisition unit 33 acquires the operation amount data from the operation amount sensor 9. The data acquisition unit 33 acquires the outer shape data from the outer shape data storage unit 32.

The data acquisition unit 33 acquires the initial design surface data indicating the initial design surface IS from the design surface data storage unit 31. The data acquisition unit 33 acquires the outer shape data indicating the size and shape of the work vehicle 1 from the outer shape data storage unit 32.

The target height calculation unit 34 calculates the target height of the cutting edge 19P based on the vehicle body position data, the vehicle body angle data, the operation amount data, the outer shape data, and the initial design surface data.

<Blade Control Device>

The blade control device 10 includes an initial design surface acquisition unit 101, an inflection position search unit 102, a corrected design surface generation unit 103, a blade control unit 104, a vehicle data acquisition unit 120, an actual height calculation unit 109, a target height acquisition unit 110, and a target height correction unit 111.

The initial design surface acquisition unit 101 acquires, from the design surface data storage unit 31, the initial design surface IS indicating the target shape of the excavation object to be excavated by the blade 19.

The inflection position search unit 102 searches for an inflection position CP indicating a boundary between a first surface F1 and a second surface F2 existing in front of the work vehicle 1 on the initial design surface IS.

Figure 4:
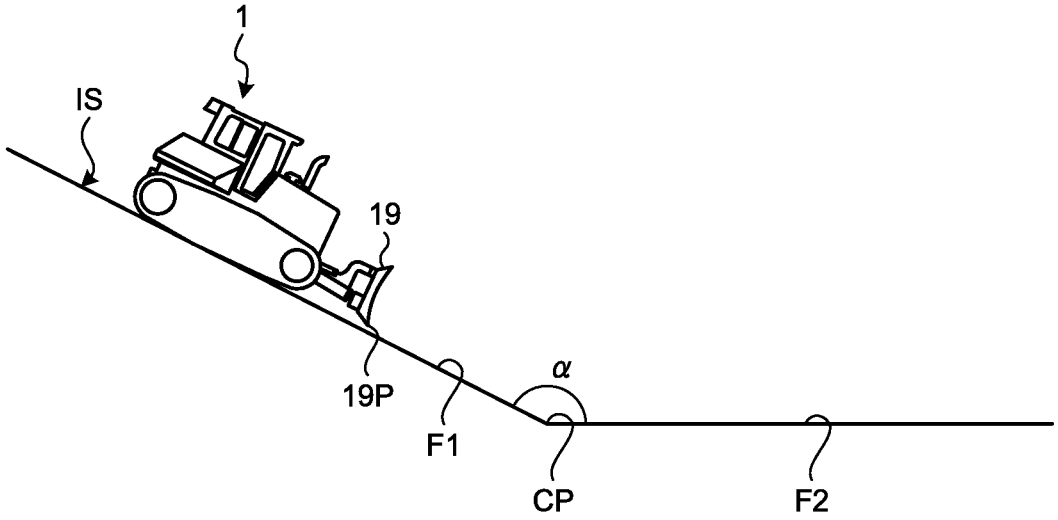
FIG. 4 is a view schematically illustrating an initial design surface according to the present embodiment.

FIG. 4 is a view schematically illustrating the initial design surface IS according to the present embodiment. The initial design surface IS may include a plurality of surfaces having different slopes. In the example illustrated in FIG. 4, the first surface F1 of the initial design surface IS exists in front of the work vehicle 1, and the second surface F2 exists in front of the first surface F1. The first surface F1 and the second surface F2 have mutually different slopes. On the initial design surface, the angle $\alpha$ formed by the first surface F1 and the second surface F2 is smaller than 180[°]. In the example illustrated in FIG. 4, the first surface F1 is inclined downward toward the front of the work vehicle 1. The second surface F2 is substantially parallel to the horizontal plane. The second surface F2 is connected to a lowermost part of the first surface F1. The lowermost part of the first surface F1 is the foot of slope.

The inflection position search unit 102 can search for the inflection position CP indicating the boundary between the first surface F1 and the second surface F2, based on the initial design surface data acquired by the initial design surface acquisition unit 101.

The inflection position search unit 102 may search for the inflection position CP in the two-dimensional plane or may search for the inflection position CP in the three-dimensional space. In the case of searching for the inflection position CP in the two-dimensional plane, the inflection position search unit 102 can specify the inflection position CP by searching for an intersection of the first surface F1 and the second surface F2 on an intersection line between a surface extending in the front-rear direction through the cutting edge 19P in the local coordinate system and the initial design surface IS. In the case of searching for the inflection position CP in the three-dimensional space, the inflection position search unit 102 can specify the inflection position CP based on how the height data of the initial design surface IS existing in front of the vehicle body 2 changes with respect to the vehicle body 2.

The corrected design surface generation unit 103 generates a corrected design surface CS that connects the first surface F1 existing in front of the work vehicle 1 on the initial design surface IS and the second surface F2 having a slope different from the slope of the first surface F1.

Figure 5:
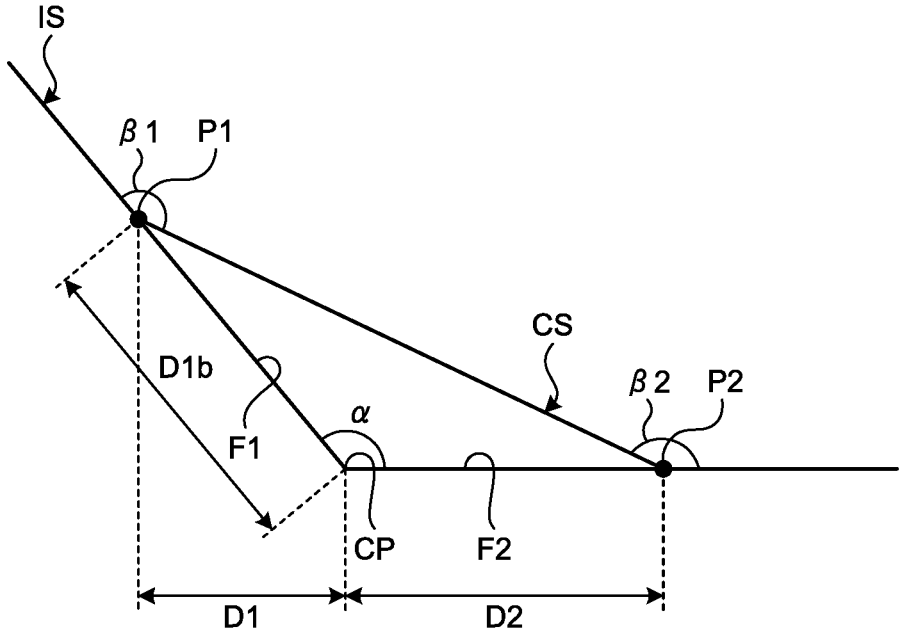
FIG. 5 is a view schematically illustrating a corrected design surface according to the present embodiment.

FIG. 5 is a view schematically illustrating the corrected design surface CS according to the present embodiment. The corrected design surface generation unit 103 generates the corrected design surface CS based on the inflection position CP.

The corrected design surface generation unit 103 generates the corrected design surface CS so as to connect a first portion P1 of the first surface F1 located at a first distance D1 rearward from the inflection position CP and a second portion P2 of the second surface F2 located at a second distance D2 frontward from the inflection position CP in a traveling direction of the work vehicle 1.

An angle β1 formed by the first surface F1 and the corrected design surface CS and an angle β2 formed by the second surface F2 and the corrected design surface CS are each greater than the angle α.

The corrected design surface generation unit 103 generates the corrected design surface CS when a prescribed correction condition is satisfied. The correction condition includes a condition that the angle α formed by the first surface F1 and the second surface F2 is an angle threshold or less, and a condition that a traveling speed V of the work vehicle 1 entering the first surface F1 is a speed threshold or more.

The angle α can be derived based on the initial design surface data. Furthermore, the corrected design surface generation unit 103 acquires traveling speed data indicating the traveling speed V of the work vehicle 1 from the speed sensor 8. The angle threshold and the speed threshold are predetermined values and are stored in the corrected design surface generation unit 103. Therefore, the corrected design surface generation unit 103 can determine whether the correction conditions are satisfied based on the initial design surface data acquired by the initial design surface acquisition unit 101, the traveling speed data acquired from the speed sensor 8, the angle threshold, and the speed threshold.

In the present embodiment, the corrected design surface generation unit 103 sets the first distance D1 and the second distance D2 so as to be in conjunction with the angle α and the traveling speed V. The corrected design surface generation unit 103 sets the values such that the smaller the angle α, the longer the first distance D1 and the second distance D2 become, and such that the greater the angle α, the shorter the first distance D1 and the second distance D2 become. The corrected design surface generation unit 103 sets the values such that the higher the traveling speed V, the longer the first distance D1 and the second distance D2 become, and such that the lower the traveling speed V, the shorter the first distance D1 and the second distance D2 become.

The corrected design surface generation unit 103 may generate the corrected design surface CS such that the smaller the angle α, the greater the angle β1 and the angle β2 become, and such that the greater the angle α, the smaller the angle β1 and the angle β2 become. The corrected design surface generation unit 103 may generate the corrected design surface CS such that the lower the traveling speed V, the greater the angle β1 and the angle β2 become, and such that the lower the traveling speed V, the smaller the angle β1 and the angle β2 become.

In the example illustrated in FIG. 5, the first distance D1 and the second distance D2 are distances from the inflection position CP in a direction parallel to the second surface F2. Alternatively, a first distance D1*b* from the inflection position CP in a direction parallel to the first surface F1 may be set as the first distance D1.

The vehicle data acquisition unit 120 acquires vehicle data indicating data related to the work vehicle 1 from the data acquisition unit 33. As described above, the vehicle data includes the vehicle body position data, the vehicle body angle data, the operation amount data, and the outer shape data. The vehicle data acquisition unit 120 includes a vehicle body position acquisition unit 105, a vehicle body angle acquisition unit 106, an operation amount acquisition unit 107, and an outer shape data acquisition unit 108.

The vehicle body position acquisition unit 105 acquires vehicle body position data indicating the position of the vehicle body 2 from the data acquisition unit 33. The vehicle body angle acquisition unit 106 acquires vehicle body angle data indicating the inclination angle of the vehicle body 2 from the data acquisition unit 33. The operation amount acquisition unit 107 acquires operation amount data indicating the operation amount of the lift cylinder 25 capable of moving the blade 19, from the data acquisition unit 33. The outer shape data acquisition unit 108 acquires outer shape data indicating the size and shape of the work vehicle 1 from the data acquisition unit 33.

The actual height calculation unit 109 calculates an actual height indicating an actual height of the cutting edge 19P of the blade 19 in the local coordinate system based on the vehicle data acquired by the vehicle data acquisition unit 120. That is, the actual height calculation unit 109 calculates the actual height indicating the actual height of the cutting edge 19P of the blade 19 in the local coordinate system based on the vehicle body position data, the vehicle body angle data, the operation amount data, and the outer shape data.

The actual height calculation unit 109 calculates the lift angle A of the blade 19 based on the operation amount data. The actual height calculation unit 109 calculates the height of the cutting edge 19P of the blade 19 in the local coordinate system based on the lift angle A and the outer shape data. The actual height calculation unit 109 may calculate the height of the cutting edge 19P based on a lift angle A representing an angle of the blade 19 in the lift direction, an angular-direction angle representing an angle of the blade 19 in the angular direction, and an angular-direction angle representing an angle of the blade 19 in the tilt direction, and the outer shape data. Furthermore, the actual height calculation unit 109 can calculate the height of the cutting edge 19P of the blade 19 in the global coordinate system based on the origin of the local coordinate system and the detection data of the position sensor 6.

The target height acquisition unit 110 acquires, from the target height calculation unit 34, the target height of the cutting edge 19P calculated by the target height calculation unit 34.

The target height correction unit 111 corrects the target height based on the corrected design surface CS to generate the corrected target height of the cutting edge 19P of the blade 19. The corrected target height of the cutting edge 19P refers to the position of the cutting edge 19P that can be aligned with the corrected design surface CS in the local coordinate system.

The blade control unit 104 outputs a control command to control the height of the cutting edge 19P of the blade 19, based on the corrected design surface CS. The blade control unit 104 outputs the control command so that the cutting edge 19P is aligned with the corrected design surface CS. The blade control unit 104 outputs the control command to the control valve 28.

In a case where the cutting edge 19P of the blade 19 is located behind the first portion P1 or in front of the second portion P2, that is, in a state of being positioned on the initial design surface IS, the blade control unit 104 outputs the control command so as to reduce a deviation between the height of the cutting edge 19P of the blade 19 calculated by the actual height calculation unit 109 and the target height acquired by the target height acquisition unit 110.

In a case where the cutting edge 19P of the blade 19 is located between the first portion P1 and the second portion P2, that is, in a state of being positioned on the corrected design surface CS, the blade control unit 104 outputs a control command so as to reduce a deviation between the height of the cutting edge 19P of the blade 19 calculated by the actual height calculation unit 109 and the corrected target height generated by the target height correction unit 111.

[Blade Control Method]

Figure 6:
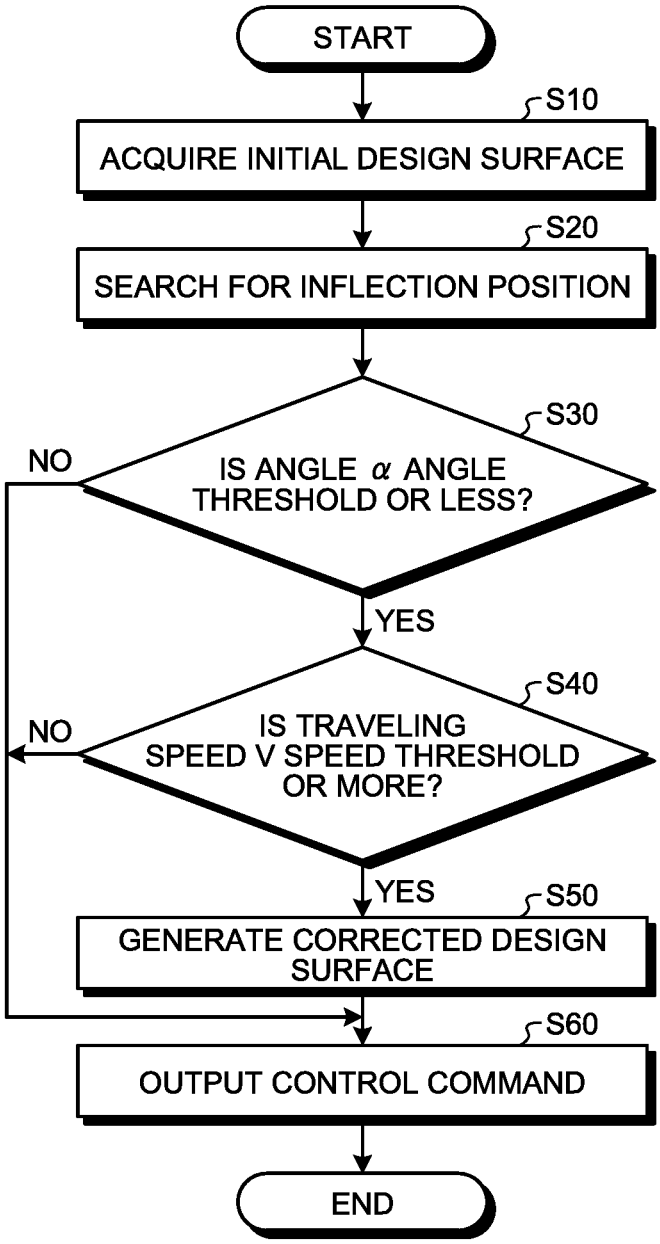
FIG. 6 is a flowchart illustrating a blade control method according to the present embodiment.

Next, a blade control method according to the present embodiment will be described. FIG. 6 is a flowchart illustrating the blade control method according to the present embodiment. The process illustrated in FIG. 6 is performed at a prescribed cycle.

The initial design surface acquisition unit 101 acquires the initial design surface IS from the design surface data storage unit 31 (step S10). In the present embodiment, in a state where the work vehicle 1 is moving forward, the initial design surface IS in a prescribed range in front of the work vehicle 1 (for example, 10 [m]) is transmitted from the target height generation device 30 to the blade control device 10. The initial design surface acquisition unit 101 acquires the initial design surface IS in the prescribed range in front of the work vehicle 1 from the design surface data storage unit 31. The initial design surface acquisition unit 101 acquires, at a prescribed cycle, an initial design surface IS in a prescribed range in front of the work vehicle 1 that changes with a forward movement of the work vehicle 1.

The inflection position search unit 102 searches for an inflection position CP indicating a boundary between the first surface F1 and the second surface F2 on the initial design surface IS acquired by the initial design surface acquisition unit 101 (step S20).

The corrected design surface generation unit 103 determines whether the initial design surface IS satisfies a prescribed correction condition. The corrected design surface generation unit 103 determines whether the angle α formed by the first surface F1 and the second surface F2 is an angle threshold or less (step S30).

In a case where it is determined in step S30 that the angle α is the angle threshold or less (step S30: Yes), the corrected design surface generation unit 103 determines whether the traveling speed V of the work vehicle 1 traveling on the first surface F1 is a speed threshold or more (step S40).

In a case where it is determined in step S40 that the traveling speed V is the speed threshold or more (step S40: Yes), the corrected design surface generation unit 103 generates the corrected design surface CS (step S50).

As described with reference to FIG. 5, the corrected design surface generation unit 103 generates the corrected design surface CS so as to connect the first portion P1 of the first surface F1 and the second portion P2 of the second surface F2. In a case where the angle α is significantly smaller than the angle threshold, the corrected design surface generation unit 103 generates the corrected design surface CS in a state where the first distance D1 and the second distance D2 are lengthened. In a case where the traveling speed V is significantly higher than the speed threshold, the corrected design surface generation unit 103 generates the corrected design surface CS in a state where the first distance D1 and the second distance D2 are lengthened.

The target height acquisition unit 110 acquires the target height of the cutting edge 19P from the target height calculation unit 34. The target height correction unit 111 acquires the target height of the cutting edge 19P from the target height acquisition unit 110. The target height correction unit 111 corrects the target height of the cutting edge 19P based on the corrected design surface CS generated by the corrected design surface generation unit 103 and then calculates the corrected target height of the cutting edge 19P.

The blade control unit 104 outputs a control command to control the height of the blade 19 to the control valve 28 based on the corrected design surface CS (step S60).

The blade control unit 104 outputs a control command so as to reduce the deviation between the height of the cutting edge 19P and the target height in a state where the cutting edge 19P is positioned on the initial design surface IS. The blade control unit 104 outputs a control command so as to reduce the deviation between the height of the cutting edge 19P and the corrected target height in a state where the cutting edge 19P is positioned on the corrected design surface CS.

In a case where it is determined in step S30 that the angle α is not the angle threshold or less (step S30: No), or where it is determined in step S40 that the traveling speed V is not the speed threshold or more (step S40: No), the correction condition is not satisfied, and therefore, the corrected design surface generation unit 103 would not generate the corrected design surface CS. The blade control unit 104 outputs a control command to control the height of the blade 19 to the control valve 28 based on the initial design surface IS.

[Action]

Figure 7:
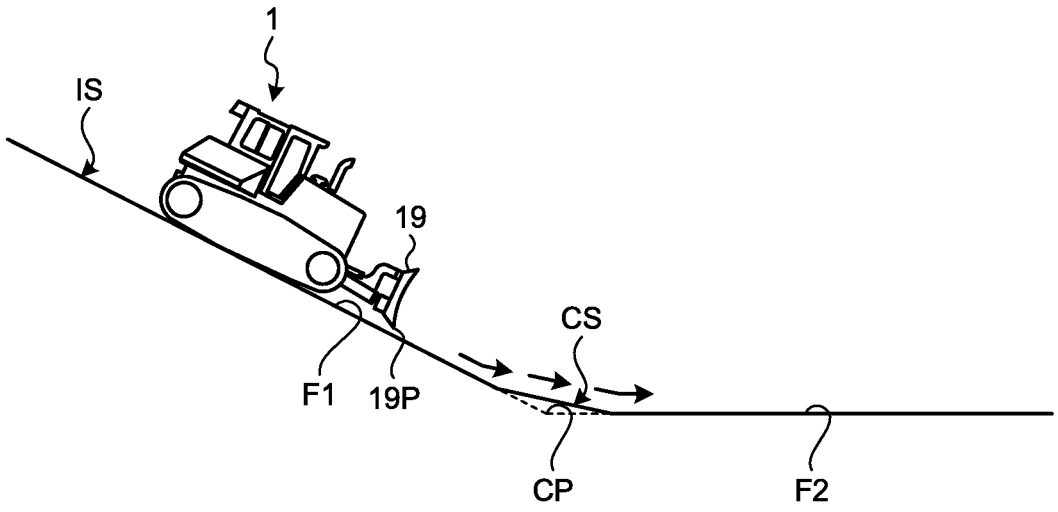
FIG. 7 is a schematic diagram illustrating an operation of the work vehicle according to the present embodiment.

FIG. 7 is a schematic diagram illustrating operation of the work vehicle 1 according to the present embodiment. The work vehicle 1 moves forward while excavating the excavation object using the blade 19. As illustrated in FIG. 7, in a state where the cutting edge 19P of the blade 19 is positioned on the first surface F1 of the initial design surface IS, the height of the blade 19 is controlled so as to reduce the deviation between the height of the cutting edge 19P and the target height, that is, so as to allow the cutting edge 19P to be aligned with the first surface F1.

In a case where the corrected design surface CS is generated, the blade control device 10 controls the height of the blade 19 so that the cutting edge 19P of the blade 19 follows the corrected design surface CS. In a state where the cutting edge 19P of the blade 19 is positioned on the corrected design surface CS, the height of the blade 19 is controlled so as to reduce the deviation between the height of the cutting edge 19P and the corrected target height, that is, so as to allow the cutting edge 19P to be aligned with the corrected design surface CS.

After the cutting edge 19P has passed the corrected design surface CS, in a state where the cutting edge 19P of the blade 19 is positioned on the second surface F2 of the initial design surface IS, the height of the blade 19 is controlled so as to reduce the deviation between the height of the cutting edge 19P and the target height, that is, so as to allow the cutting edge 19P to be aligned with the second surface F2.

Figure 8:
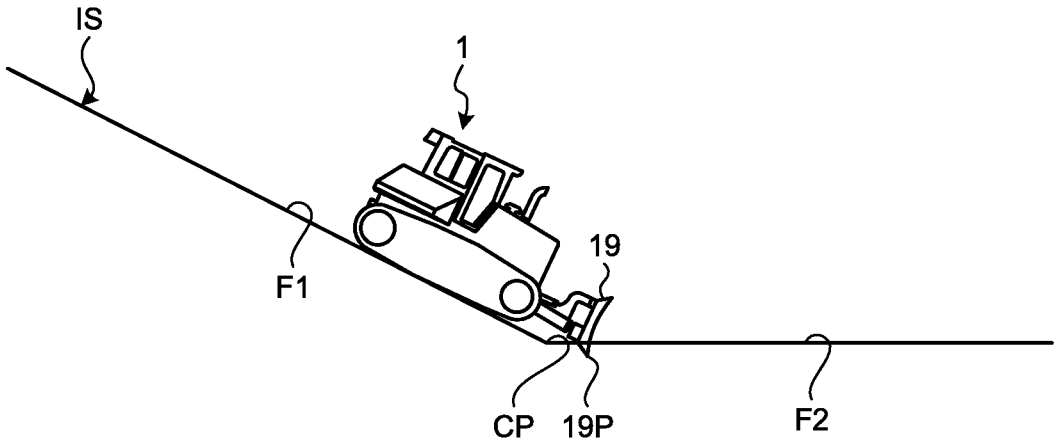
FIG. 8 is a view schematically illustrating an operation of a work vehicle according to a comparative example.

FIG. 8 is a view schematically illustrating an operation of a work vehicle 1 according to a comparative example. When the angle α formed by the first surface F1 and the second surface F2 is small, or the traveling speed V of the work vehicle 1 entering the inflection position CP is high, an occurrence of control delay of the blade 19 at the time of passage of the blade 19 through the inflection position CP might lead to a failure of the blade 19 in following the initial design surface IS. Since the height and the moving speed of the blade 19 are controlled by hydraulic pressure, there is a possibility of occurrence of control delay due to hydraulic pressure. In addition, there is another possibility of occurrence of control delay due to data communication delay. When the control delay of the blade 19 occurs, as illustrated in FIG. 8, the blade 19 might excavate the excavation object in a state where the cutting edge 19P exceeds the second surface F2 of the initial design surface IS, leading to a possible failure in excavating the excavation object into a desired shape.

In the present embodiment, the corrected design surface CS is generated in a case where the angle α is an angle threshold or less and the traveling speed V of the work vehicle 1 entering the inflection position CP is a speed threshold or more. The corrected design surface CS is generated so as to connect the first surface F1 and the second surface F2. With this configuration, the angle β1 formed between the first surface F1 and the corrected design surface CS is greater than the angle α. Therefore, even when a control delay of the blade 19 occurs, the blade 19 can be controlled so that the cutting edge 19P will follow the corrected design surface CS, making it possible to suppress the movement of the cutting edge 19P beyond the initial design surface IS. Therefore, it is possible to suppress deep excavation of the excavation object.

[Computer System]

Figure 9:
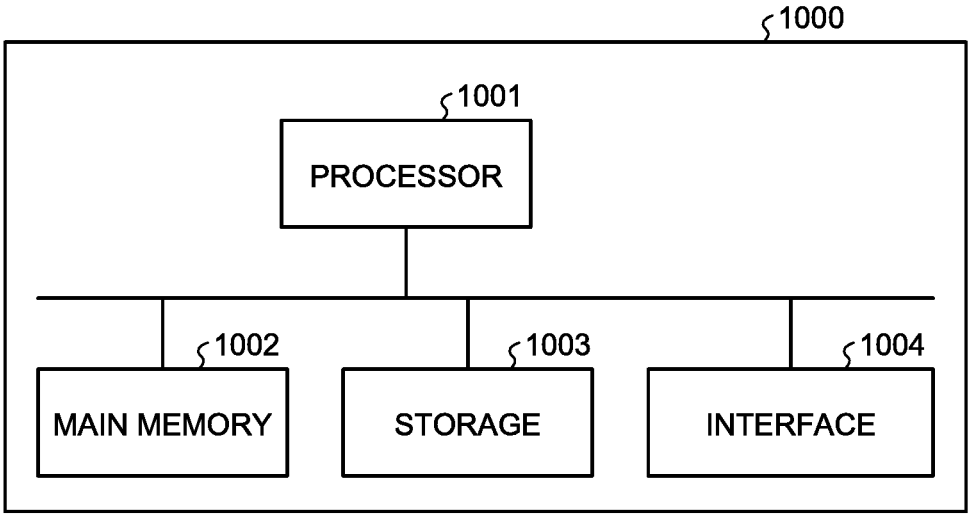
FIG. 9 is a block diagram illustrating a computer system according to the present embodiment.

FIG. 9 is a block diagram illustrating a computer system 1000 according to the present embodiment. The blade control device 10 and the target height generation device 30 described above each includes a computer system 1000. The computer system 1000 includes: a processor 1001 including a processor such as a central processing unit (CPU); main memory 1002 including non-volatile memory such as read only memory (ROM) and volatile memory such as random access memory (RAM); storage 1003; and an interface 1004 including an input/output circuit. The function of the blade control device 10 and the function of the target height generation device 30 described above are stored as a program in the storage 1003. The processor 1001 reads the program from the storage 1003, expands the program to the main memory 1002, and executes the above-described processes according to the program. The program may be delivered to the computer system 1000 via a network.

[Effects]

As described above, according to the present embodiment, the corrected design surface CS connecting the first surface F1 and the second surface F2 is generated when the prescribed correction condition is satisfied. The blade 19 is controlled so that the cutting edge 19P follows the corrected design surface CS, leading to suppression of the movement of the cutting edge 19P beyond the initial design surface IS. Therefore, deep excavation of the excavation object is suppressed, making it possible to excavate the excavation object into a desired shape.

The present embodiment searches for the inflection position CP indicating the boundary between the first surface F1 and the second surface F2. Thereby, the corrected design surface generation unit 103 can generate the corrected design surface CS based on the inflection position CP. Furthermore, in the present embodiment, the corrected design surface CS is generated so as to connect the first portion P1 of the first surface F1 located at the first distance D1 (D1*b*) from the inflection position CP and the second portion P2 of the second surface F2 located at the second distance D2 from the inflection position CP. As a result, the calculation load of the corrected design surface generation unit 103 can be reduced.

Other Embodiments

In the embodiment described above, the correction condition includes both the condition that the angle α formed by the first surface F1 and the second surface F2 is the angle threshold or less and the condition that the traveling speed V of the work vehicle 1 entering the first surface F1 is the speed threshold or more. The correction condition may be any one of the conditions that the angle α formed by the first surface F1 and the second surface F2 is the angle threshold or less and that the traveling speed V of the work vehicle 1 entering the first surface F1 is the speed threshold or more.

In the above-described embodiment, at least one of the position sensor 6 or the inclination sensor 7 may be attached to the blade 19.

The above-described embodiment is an example in which the work vehicle 1 is a bulldozer. The work vehicle 1, however, may be a motor grader having a blade mechanism.

REFERENCE SIGNS LIST

1 WORK VEHICLE
2 VEHICLE BODY
3 CARRIAGE DEVICE
4 WORKING EQUIPMENT
5 HYDRAULIC CYLINDER
6 POSITION SENSOR
7 INCLINATION SENSOR
8 SPEED SENSOR
9 OPERATION AMOUNT SENSOR
10 BLADE CONTROL DEVICE
11 CAB
12 ENGINE ROOM
13 SEAT
14 OPERATION DEVICE
15 DRIVING WHEEL
16 IDLER WHEEL
17 CRAWLER
18 LIFT FRAME
19 BLADE
19P CUTTING EDGE
20 BALL JOINT
21 PITCH SUPPORT LINK
22 SUPPORT PILLAR
23 UNIVERSAL JOINT
24 PITCHING JOINT
25 LIFT CYLINDER
26 ANGLE CYLINDER
27 TILT CYLINDER
28 CONTROL VALVE

30 TARGET HEIGHT GENERATION DEVICE
31 DESIGN SURFACE DATA STORAGE UNIT
32 OUTER SHAPE DATA STORAGE UNIT
33 DATA ACQUISITION UNIT
34 TARGET HEIGHT CALCULATION UNIT
101 INITIAL DESIGN SURFACE ACQUISITION UNIT
102 INFLECTION POSITION SEARCH UNIT
103 CORRECTED DESIGN SURFACE GENERATION UNIT
104 BLADE CONTROL UNIT
105 VEHICLE BODY POSITION ACQUISITION UNIT
106 VEHICLE BODY ANGLE ACQUISITION UNIT
107 OPERATION AMOUNT ACQUISITION UNIT
108 OUTER SHAPE DATA ACQUISITION UNIT
109 ACTUAL HEIGHT CALCULATION UNIT
110 TARGET HEIGHT ACQUISITION UNIT
111 TARGET HEIGHT CORRECTION UNIT
AX ROTATIONAL AXIS
BX ROTATIONAL AXIS
CS CORRECTED DESIGN SURFACE
CX ROTATIONAL AXIS
D1 FIRST DISTANCE
D1*b* FIRST DISTANCE
D2 SECOND DISTANCE
F1 FIRST SURFACE
F2 SECOND SURFACE
IS INITIAL DESIGN SURFACE
L STROKE LENGTH
P1 FIRST PORTION
P2 SECOND PORTION
$\alpha$ ANGLE
$\beta$1 ANGLE
$\beta$2 ANGLE
$\theta$ LIFT ANGLE

The invention claimed is:

1. A blade control device comprising:

a blade of a work vehicle;

a corrected design surface generation unit that generates a corrected design surface connecting a first surface existing in front of the work vehicle of an initial design surface indicating a target shape of an excavation object to be excavated using the blade of the work vehicle and a second surface of the initial design surface, the second surface touching the first surface and having a different slope from a slope of the first surface on the initial design surface; and a blade control unit that outputs a control command to control a height of the blade based on the corrected design surface, wherein the corrected design surface generation unit generates the corrected design surface when a prescribed correction condition is satisfied, and the correction condition is a condition that a traveling speed of the work vehicle entering the first surface is a speed threshold or more.

2. The blade control device according to claim 1, further comprising an inflection position search unit that searches for an inflection position indicating a boundary between the first surface and the second surface on the initial design surface, wherein the corrected design surface generation unit generates the corrected design surface based on the inflection position.

3. The blade control device according to claim 2, wherein the corrected design surface generation unit generates the corrected design surface so as to connect a first portion of the first surface located at a first distance from the inflection position and a second portion of the second surface located at a second distance from the inflection position.

4. The blade control device according to claim 1, wherein the correction condition also includes a condition that an angle formed by the first surface and the second surface is an angle threshold or less.

5. The blade control device according to claim 4, wherein the angle formed by the first surface and the second surface is smaller than 180[° ] on the initial design surface.

6. The blade control device according to claim 1, further comprising:

an actual height calculation unit that calculates the height of the blade based on vehicle data related to the work vehicle;

a target height acquisition unit that acquires a target height of the blade calculated based on the initial design surface; and a target height correction unit that corrects the target height based on the corrected design surface to generate a corrected target height, wherein the blade control unit outputs the control command so as to reduce a deviation between a height of a cutting edge of the blade and the target height in a state where the cutting edge of the blade is positioned on the initial design surface, and outputs the control command so as to reduce a deviation between the height of the cutting edge of the blade and the corrected target height in a state where the cutting edge of the blade is positioned on the corrected design surface.

7. A blade control method comprising:

providing a blade of a work vehicle;

generating a corrected design surface connecting a first surface existing in front of the work vehicle of an initial design surface indicating a target shape of an excavation object to be excavated using the blade of the work vehicle and a second surface of the initial design surface, the second surface touching the first surface and having a different slope from a slope of the first surface on the initial design surface; and outputting a control command to control a height of the blade based on the corrected design surface, wherein the corrected design surface is generated when a prescribed correction condition is satisfied, and the correction condition is a condition that a traveling speed of the work vehicle entering the first surface is a speed threshold or more.

* * * * *